US005947685A

United States Patent [19]

Yu

[11] Patent Number: 5,947,685

[45] **Date of Patent: *Sep. 7, 1999**

[54] CEILING FAN HOUSING COMBINATION

[76] Inventor: Jack Yu, No. 109-1, Avenue, 6 Lane, 164, Tzong Sa Road. Da Du Hsiang, Taichung Hsien, Taiwan

[ * ] Notice: This patent is subject to a terminal disclaimer.

[21] Appl. No.: 08/919,390

[22] Filed: Aug. 28, 1997

[51] Int. Cl.[6] ..... F04D 29/00

[52] U.S. Cl. ..... 416/5; 416/93 R; 417/423.14; 310/89

[58] Field of Search ..... 416/5, 93 R, 170 R; D23/377, 379, 385, 411; 417/423.14; 310/89; 362/147, 363, 367

[56] References Cited

U.S. PATENT DOCUMENTS 4,626,970 12/1986 Huang ..... 362/147
4,863,346 9/1989 Lin ..... 416/5
5,439,350 8/1995 Yu .
5,441,387 8/1995 Yu .
5,503,524 4/1996 Yu .
5,681,147 10/1997 Yung-Chung ..... 416/5

*Primary Examiner*—Christopher Verdier
*Attorney, Agent, or Firm*—Charles E. Baxley, Esq.

[57] ABSTRACT

A ceiling fan housing includes a cylindrical member having a number of openings and includes a bottom portion having a number of punctures. A number of panels are secured to the cylindrical member and the bottom portion and engaged in the openings 8 the cylindrical member and in the of the bottom portion punctures. The panels each include a plate engaged in the openings of the cylindrical member or the bottom portion flush with its associated outer peripheral surface of the ceiling fan housing. The panels include beautiful colors and are directly secured to the ceiling fan housing for reducing the cost and for simplifying and accelerating the manufacturing processes.

1 Claim, 2 Drawing Sheets

CEILING FAN HOUSING COMBINATION

BACKGROUND OF THE INVENTION

1. Field of the Invention

The present invention relates to a housing, and more particularly to a ceiling fan housing combination.

2. Description of the Prior Art

The closest prior art of which applicant is aware is his prior U.S. Pat. No. 5,441,387 to Yu, filed on Oct. 26, 1994, entitled "HOUSING COMBINATION FOR CEILING FAN". However, in the '387 patent the panels are required to be engaged in the channels of the frames such that the frames and the panels may not be easily assembled.

The present invention has arisen to mitigate and/or obviate the afore-described disadvantage of the conventional ceiling fan housings.

SUMMARY OF THE INVENTION

The primary objective of the present invention is to provide a ceiling fan housing combination which includes a number of panels that easily can be assembled to the housing.

In accordance with one aspect of the invention, there is provided a ceiling fan housing combination comprising a body including a cylindrical member having an upper portion and having at least one opening and having an inner peripheral surface and having an outer peripheral surface, the body including a bottom portion having at least one puncture and having an upper surface and having a bottom surface, a cover engaged on the upper portion of the cylindrical member, means for coupling the body and the cover together, and at least one cylinder panel secured to the cylindrical member and at least one bottom panel secured to the bottom portion of the body and the cylinder panel engaged in the at least one opening and the bottom panel engaged in the at least one puncture.

The cylinder panels bottom panels each include a plate for engaging in its associated the at least one opening and the at least one puncture respectively. Each of the plates of the cylinder panels and of the bottom panels includes two sides each having an ear for engaging respectively with the associated inner peripheral surface of the cylindrical member or with the respective upper surface of the bottom portion of the body, the plates each include an outer surface for flush with a respective outer peripheral surface of the associated cylindrical member or with a respective bottom surface of the associated bottom portion of the body.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
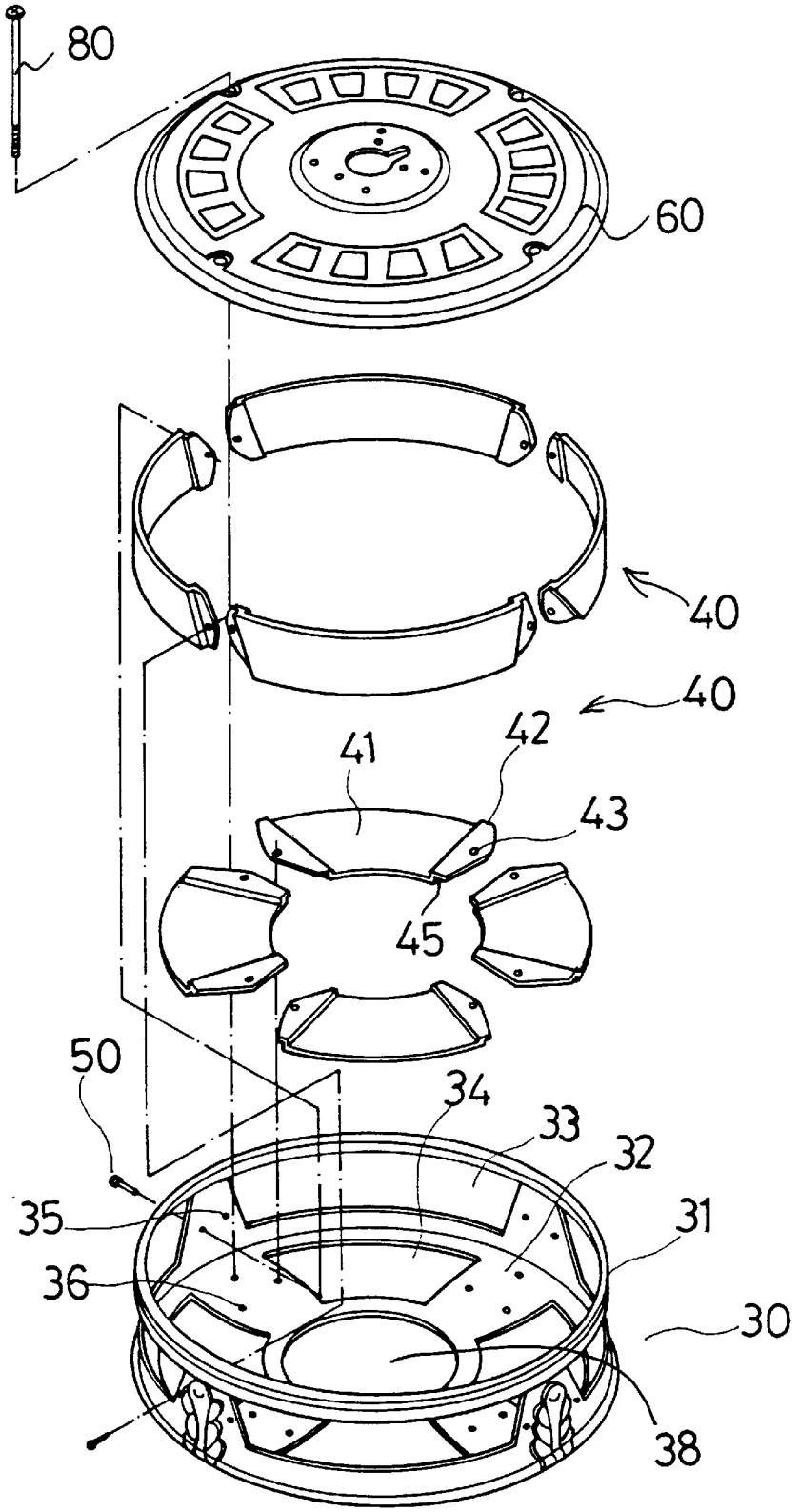
FIG. 1 is an exploded view of a ceiling fan housing in accordance with the present invention.

Referring to the drawings, a ceiling fan housing combination in accordance with the present invention comprises a body generally designated 30 including a cylindrical member 31 and including an annular bottom portion 32 having an orifice 38 for engaging with a motor shaft of the ceiling fan.

The cylindrical member 31 includes one or more openings 33 and includes a number of holes 35 formed beside the openings 33 for engaging with fasteners 50. The bottom portion 32 of the body 30 includes one or more punctures 34 and includes a number of holes 36 formed beside the punctures 34 for engaging with fasteners 50. A cover 60 is secured on top of the body 30. A number of fasteners 80 are engaged through the cover 60 and the bottom portion 32 of the body 30 for securing the cover 60 to the body 30 and for receiving a ceiling fan motor in the body 30.

Figure 2:
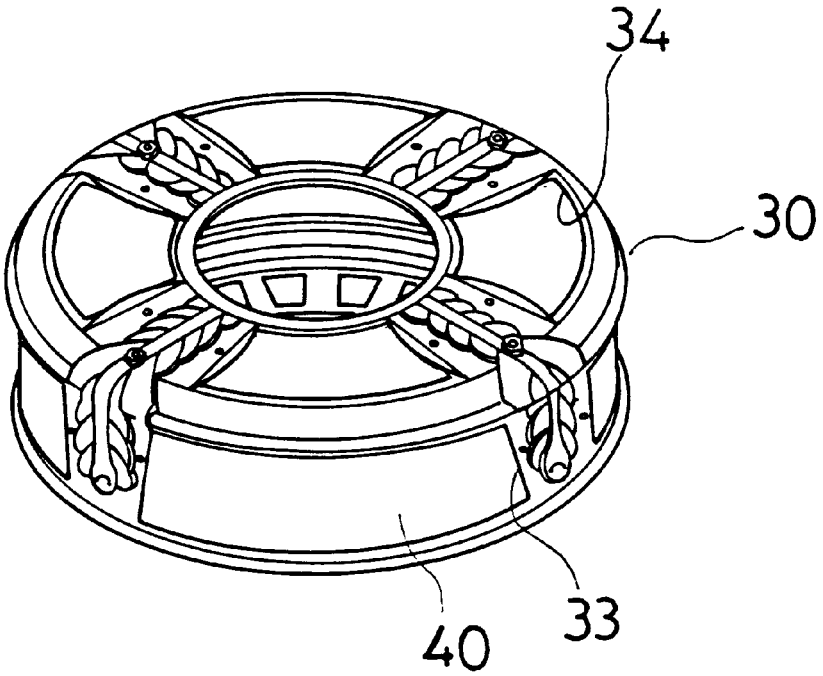
FIG. 2 is a bottom perspective view of the ceiling fan housing.
Figure 3:
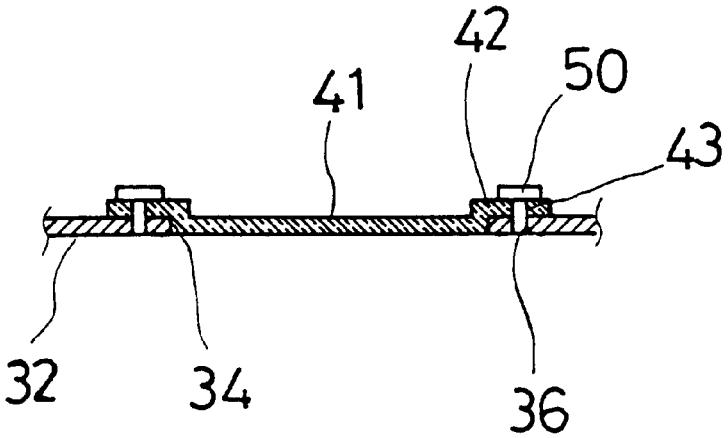
FIG. 3 is a partial cross sectional view illustrating the attachment one of the bottom panels to the housing.

A number of cylinder panels and bottom 40 each include a plate 41 for engaging with the openings 33 and the punctures 34 and each include two end portions each having an ear 42 for engaging respectively with the cylindrical member 31 or the bottom portion 32 of the body 30. The ears 42 of the panels 40 each include a hole 43 for engaging with the fasteners 50 and for securing the panels 40 to the body 30. A shoulder 45 is formed between the plate 41 and its ears 42 for positioning the plate 41 to be flush with the associated outer peripheral surface of the respective cylindrical member 31 or flush with the bottom surface of the associated bottom portion 32 (FIGS. 2, 3) and for allowing the ears 42 to engage with the respective inner peripheral surface of the cylindrical member 31 or to engage with the respective upper surface of the bottom portion 32 (FIGS. 2, 3).

It is to be noted that the panels 40 are preferably made of transparent materials having beautiful colors for decoration purposes. The panels 40 are directly secured to the body 30 and are not required to be secured in a number of frames before the panels 40 may be secured to the body 30 such that the ceiling fan housing combination may be made with greatly reduced cost and may be assembled quickly.

Accordingly, the ceiling fan housing in accordance with the present invention includes a number of panels that may be directly secured to the body for greatly reducing the manufacturing costs and the assembling processes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ceiling fan housing comprising:

a body including a cylindrical member having an upper portion, and having at least one opening, and having an inner peripheral surface, and having an outer peripheral surface;

the body including a bottom portion having at least one puncture and having an upper surface and having a bottom surface;

a cover engaged on the upper portion of the cylindrical member;

means for coupling the body and the cover together;

at least one frameless cylinder panel including a cylinder plate for engaging in the at least one opening, and the at least one cylinder plate includes two ends each having an ear for engaging with the inner peripheral surface of the cylindrical member, the at least one cylinder plate includes an outer surface flush with the outer peripheral surface of the cylindrical member;

at least one frameless bottom panel secured to the bottom portion including a bottom plate for engaging in the at least one puncture, the at least one bottom plate includes two ends each having an ear for engaging with the upper surface of the bottom portion, and the at least one bottom plate includes an outer surface flush with the bottom surface of the bottom portion.

* * * * *